United States Patent [19]

Wiltse

[11] 4,440,185

[45] Apr. 3, 1984

[54] SUPPORT STAND FOR A FOOD SLICER

[76] Inventor: Dean P. Wiltse, P.O. Box 215, Oscoda, Mich. 48750

[21] Appl. No.: 409,322

[22] Filed: Aug. 18, 1982

[51] Int. Cl.[3] ..... B08B 3/02

[52] U.S. Cl. ..... 134/104; 134/115 R

[58] Field of Search ..... 134/104, 115 R, 115 G

[56] References Cited

U.S. PATENT DOCUMENTS

| | | | |
|---|---|---|---|
| 2,573,965 | 11/1951 | Guglielmoni | 134/88 |
| 2,627,863 | 2/1953 | Cavicchioli | 134/104 |
| 2,677,587 | 5/1954 | Waldo, Sr. | 312/249 |
| 2,760,207 | 8/1956 | Glintz | 4/159 |
| 2,786,001 | 3/1957 | De Baun | 134/104 X |
| 3,041,957 | 7/1962 | Liptay | 98/115 |
| 3,215,483 | 5/1963 | Nelson | 312/349 |
| 3,582,173 | 6/1971 | Noren et al. | 312/319 |
| 4,073,555 | 2/1978 | Noren | 312/229 |

FOREIGN PATENT DOCUMENTS

| | | | |
|---|---|---|---|
| 2831961 | 2/1980 | Fed. Rep. of Germany | 134/104 |

*Primary Examiner*—Robert L. Bleutge

*Attorney, Agent, or Firm*—Gifford, VanOphem, Sheridan & Sprinkle

[57] ABSTRACT

A food slicer support stand comprising a frame, a support platform for supporting the slicer, a drain receptacle secured to the drain below the support platform, and a vertically displaceable housing which encloses an area around the food slicer in its upper position and which retracts below the food slicer in its lower position. The stand preferably includes fluid conduits in communication with a supply of chlorine so that the chlorine is siphoned into a hose which is manually directed to discharge a spray of pressurized fluid against the slicer.

9 Claims, 4 Drawing Figures

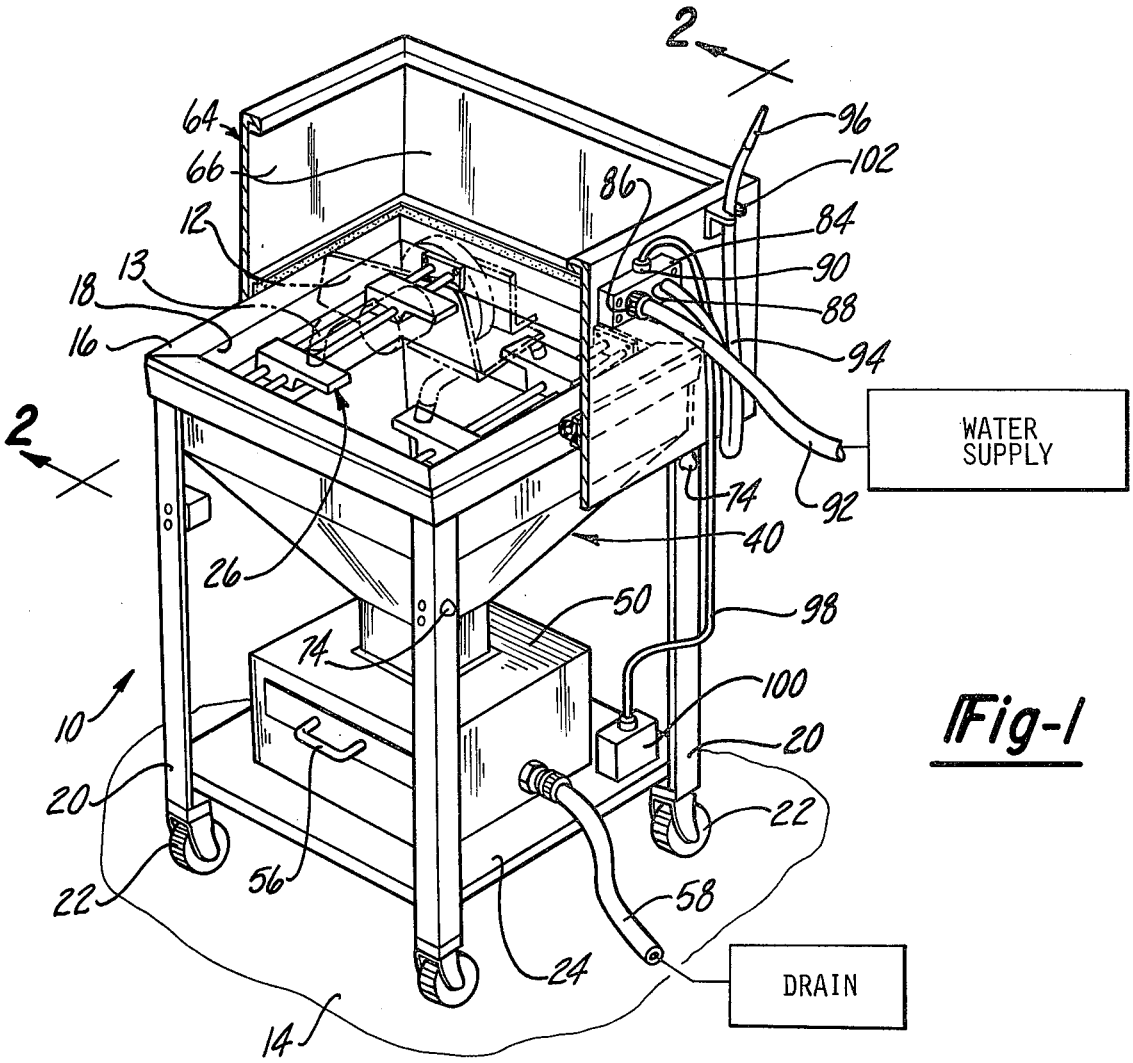
Fig-1
Fig-3
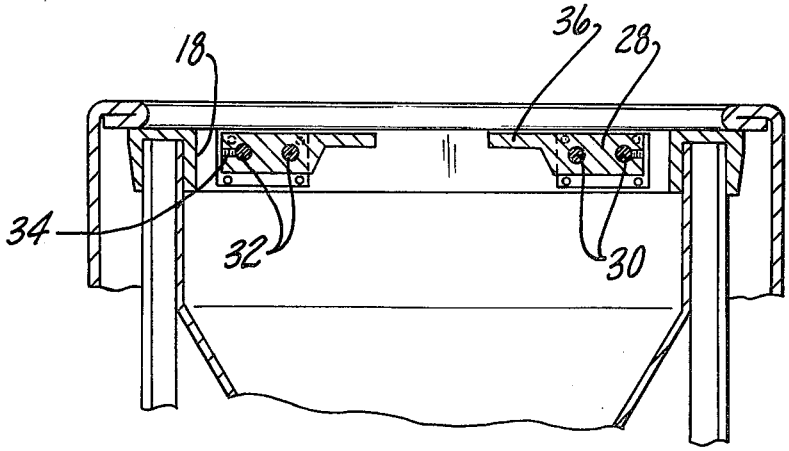

SUPPORT STAND FOR A FOOD SLICER

BACKGROUND OF THE INVENTION

I. Field of the Present Invention

The present invention relates generally to supports for tools or other machinery, and more particularly, to a support stand for a food slicer in which a movable housing provides a spray chamber for cleaning of the slicer.

II. Description of the Prior Art

Food products are often sliced before sold to a purchaser or served in a restaurant. Since food stores and restaurants deal with a large variety and volume of foods which must be sliced, motorized food slicers are often used in such establishments. However, since such machines can be expensive, and can save time and labor in the cutting of various foods, such establishments quite often purchase only a single such slicer. When a single slicer is used, it is advantageous to clean the slicer after slicing each different food so that flavors of the foods are not intermixed and so that a large amount of debris does not accumulate around the slicer. Nevertheless, manual wiping of the slicer parts is extremely time consuming and labor intensive. The accumulated debris must also be disposed of and such disposal contributes to the complexity and labor of the cleaning operation.

The food slicers are typically supported on a flat table or counter. This debris can accumulate upon the table as well as the slicer. Moreover, the debris, especially the liquids can fall to the floor and contaminate the work area, thereby creating a risk of injury to workers in the area. While the motorized portion of the slicer may be enclosed and protected from contamination by liquids and particulate food scraps released or produced during cutting of the foods, it would not be practical to clean the slicer by discharging a forceful spray of pressurized water to remove the debris from the slicer for the reason that the debris would be scattered throughout the work area by such a cleaning means. Moreover, it would be extremely difficult to move the food slicer to a sink for repeated washing operations. In addition, while the slicer may be placed upon a drain board to prevent liquid or particulate debris from contaminating the floor of the work area, such a board would not prevent the debris from being scattered if the slicer is subjected to a forceful spray of water to clean the slicer. Moreover, such a spray would not disinfect any stale buildups of food which can accumulate or become lodged on portions of the slicer.

SUMMARY OF THE PRESENT INVENTION

The present invention overcomes the above mentioned disadvantages by providing a support stand for a food processor such as a food slicer having a drain mechanism below the slicer and a displaceable housing for enclosing the slicer within a substantially enclosed chamber for cleaning of the slicer. The apparatus generally comprises a frame having a central opening which is supported by a plurality of support legs and a platform structure for supporting the food slicer thereon. Directly below the platform structure, the frame supports a receptacle including a drain for collecting the food scraps and the debris which accumulate during operation of the slicer. Preferably, the drain includes a removable filtering device for separating particulate matter from liquid. In addition, the apparatus includes a displaceable housing which slides along the legs of the frame to and between a first position extending above and around the food slicer platform and a second position in which the housing extends below the food slicer about the legs of the frame. The legs are preferably supported by means for displacing the stand, such as caster wheels.

Preferably, the support platform structure comprises at least one support plate having a total surface area less than the opening in the support frame so that the food scraps and debris can fall through the opening into the receptacle below the top of the frame. Preferably, the support platform structure comprises a plurality of support legs which are adjustably secured in the frame opening, each of which has an area substantially less than the area of the frame opening so that a substantial portion of the opening remains free of obstruction from falling food debris.

The apparatus also preferably includes sealing means between the frame and the displaceable housing so that when the housing is in its upper position, the housing is sealed with a watertight seal against the frame so that water and debris are confined to the enclosed area above the opening in the frame and the receptacle. Furthermore, although it will be understood that practically any pressurized fluid source can be used in conjunction with the stand of the present invention, the stand preferably includes fluid conduit means for directing a controlled discharge of pressurized fluid into the wash chamber formed by the housing. Preferably, the conduit means includes means for introducing a disinfectant or antiseptic solution to the pressurized fluid supply so that the cleaning solution serves to disinfect any crevices or corners of the apparatus in which food scraps tend to become lodged.

Thus, the present invention provides a sturdy, yet portable stand, for a food slicer which enables the slicer to be cleaned by spraying the slicer with a fluid discharged under pressure against the slicer. The device collects the food scraps and debris which accumulate from repeated cutting of foods and prevents the spraying or scattering of the cleaning fluid or the debris throughout the work area. In addition, the stand is adapted to fit a wide variety of processing or slicing machines and can be moved to any desired work area.

BRIEF DESCRIPTION OF THE DRAWING

The present invention will be more clearly understood by reference to the following detailed description of a preferred embodiment of the present invention when read in conjunction with the accompanying drawing in which:

FIG. 1 is a perspective view of a food slicer washing stand in accordance with the present invention;

FIG. 3 is a section elevation of a portion of the device shown in FIGS. 1 and 2.

DETAILED DESCRIPTION OF A PREFERRED EMBODIMENT OF THE PRESENT INVENTION

Figure 2:
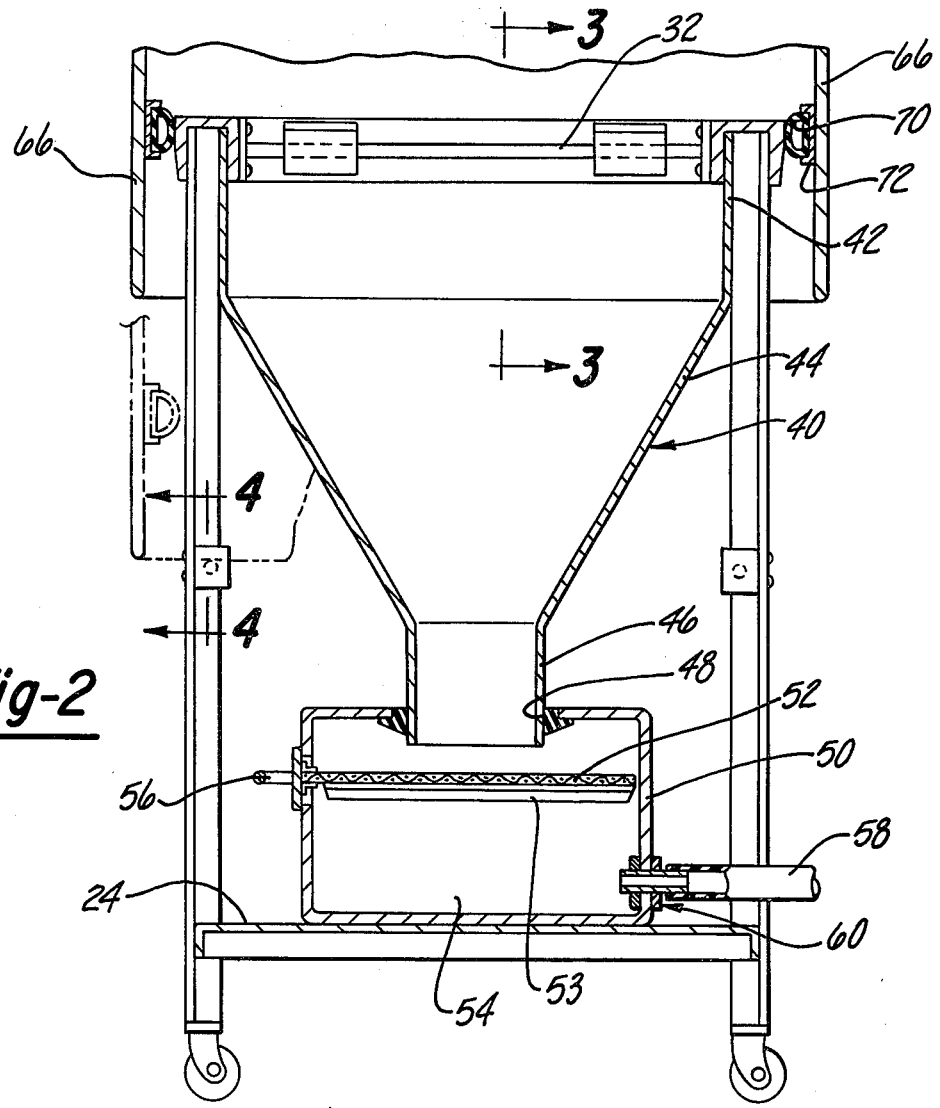
FIG. 2 is a sectional elevation of a device shown in FIG. 1.

Referring now to FIG. 1, the food slicer support stand 10 is thereshown supporting a food slicer 12 in a raised position above a ground surface 14. The apparatus 10 includes a substantially rectangular frame portion 16 having substantially U-shaped channel members which define a central opening 18. The rectangular frame portion 16 is secured at the top of a plurality of vertical leg members 20. Each leg member 20, is provided with a caster wheel 22 at its lower end to permit the stand to be moved to a desired location. The stand 10 further includes a shelf platform 24 at the lower end of the legs 20.

A support platform means 26 is secured to the stand within the central opening 18 of the rectangular frame portion 16. As shown in FIGS. 1 through 3, the platform comprises four platform legs 28 having a pair of throughbores 30 which slidably receive a pair of rails 32 secured across the opening 18 of the rectangular frame portion 16. While each platform leg 28 is slidable along support rails 32, each support leg includes means, such as a set screw 34, for locking the platform leg in a particular position along the rails within the opening 18. Moreover, while support rails 32 are rigidly secured in position across the opening 18 of rectangular frame portion 16, the platform legs 28 include extended flange portions 36 which expand the top surface area of each leg 28 so that the support legs can provide a stable support for the slicer 12 at substantially any position at which a support stanchion or leg 13 of the slicer 12 may be disposed within the opening 18. However, it will be understood that the total area covered by the platform legs 28 is substantially smaller than the area of the opening 18 in the rectangular frame portion 16. Accordingly, the platform legs 28 can support the food slicer at any position within the opening without substantially obstructing the area below the food slicer 12.

The stand 10 also includes a debris receptacle 40 having a rectangular upper portion 42 (FIG. 2) secured within the channels of the peripheral framing members of the frame portion 16. A funnel portion 44 (FIG. 2) of the receptacle 40 leads to a lower drain passage 46 at the bottom of the receptacle 40. The drain passage portion 46 extends into aperture 48 in a collection box housing 50 supported on the lower shelf 24. The housing 50 defines an internal chamber 54 which has an upper portion separated from the lower portion by a removable screen 52 extending across chamber 54 below the drain passage 46. The screen 52 includes a handle 56 extending outwardly from the collection box 50, and means for slidably supporting the screen in housing 50, such as rails 53, so that the screen 52 can be easily removed from the collection box housing 50 for cleaning. A fluid drain conduit 58 is secured by an appropriate coupling 60 to the lower portion of the collection box 50 below the screen 52.

The stand 10 also includes a sliding housing 64 which slides vertically about the periphery of the rectangular frame portion 16. As shown in FIGS. 1 through 3, the housing has four side walls 66 having lateral flanges 68 at the top end of each side wall. As best shown in FIG. 3, flanges 68 extend inwardly over the top of the rectangular frame portion 16 so as to abut against the frame to maintain the housing 64 in its lower position.

Figure 4:
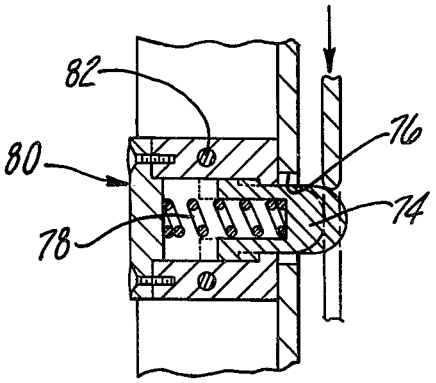
FIG. 4 is a sectional view taken substantially along line 4—4 in FIG. 2.

A resilient seal member 70 is secured by bracket 72 to the inner surface of each side wall 66 near the lower end of each wall 66, so that the housing 64 seals against the outer leg of the channel members forming the frame section 16 when the housing 64 is in its upper position as shown in FIG. 2. Referring again to FIG. 1, the housing 64 is maintained in its upper position by retractable plungers 74 extending outwardly from an aperture in each leg 20. As best shown in FIG. 4, each plunger 74 is urged outwardly from an aperture 76 in each leg 20 by a spring 78 entrained in a housing 80 secured to the leg by bolts 82. The plungers 74 serve as an abutment surface for the lower edges of the housing 64 when in its extended position to maintain the housing in its upper position. However, by depressing the plungers 74 into the housing 80, the housing can be lowered while the plunger continues to be urged against the inner surface of the side walls 66 to guide the housing 64 as it is lowered from its upper to its lower position.

Referring again to FIG. 1, the stand 10 is preferably provided with a fluid conduit means for providing a pressurized fluid to the cleaning chamber formed by the housing 64 when the housing is in its upper position. A fluid housing coupling 84 is secured to one side of the housing 64. The housing includes an inlet aperture 86 and an outlet aperture 88 which are in fluid communication with each other. The housing further includes an aperture 90 in fluid communication with but intermediate the inlet aperture 86 and the outlet aperture 88. The inlet aperture 86 is connected by an appropriate coupling to one end of a hose 92 whose other end is appropriately coupled to a water supply such as a conventional faucet. The outlet aperture 88 is connected by an appropriate coupling to one end of a hose 94 having a nozzle 96 secured at its other end. The aperture 90 is secured by an appropriate coupling to one end of a hose 98 whose other end is in fluid communication with a supply 100 of disinfectant solution such as chlorine. As shown in FIG. 1, the supply 100 can be provided by a vented canister supported by the lower shelf 24. A bracket 102 is secured to the side of the housing 64 for supporting the hose 94 when the hose is not being used.

Having thus described the important structural features of the preferred embodiment of the present invention, the operation of the device in accordance with the invention is readily described. With the housing 64 in its lower position, the area above the frame portion 16 is unobstructed and permits the slicer 12 to be placed on the support means 26 without interference The platform legs 28 are slid along the rails 30 into a position to correspond with the support legs 13 or the like of the food slicer 12, and then locked into position by tightening the set screw 34. Since a pair of spaced apart rails support each platform leg 28, they provide a stable support for the food slicer 12. Nevertheless, it can be seen that a substantial portion of the opening 18 is not obstructed by the support structure 26. Accordingly, a large portion of the food scraps formed during cutting of the food products fall directly into the receptacle 40.

Whenever it is desired to clean the food slicer, for example, after a desired amount of the particular food product has been sliced, the housing 64 is lifted to its upper position at which resilient seal members 70 engage the outer edges of the frame portion 16. The plungers 74 then extend outwardly below the bottom edges of the housing 64 to support the housing 64 in its upper position. The hose 94 is removed from support bracket 102 so that the nozzle 96 can be manually directed toward the slicer 12 in the chamber formed by the housing 64. When the water supply is activated, the water flows through the hose 92, through the housing 84 to hose 94 from which it is discharged in a spray by the nozzle 96. As the water flows through the housing 84, a siphon effect causes a flow of fluid from the supply 100 through the hose 98 which mixes with the water supply. Thus, the fluid discharged from the hose 94 not only forces food scraps into the receptacle 40, but also disinfects portions of the machinery where food scraps can collect and become lodged. The housing 64 confines the spray and the food scraps to an area directly above the receptacle 40 and thus prevents contamination of the work area around the stand 10.

Since the cleaning chamber formed by the housing 64 is sealed about the frame section 16, all of the cleaning fluid as well as the food scraps fall into the receptacle 40 and into the collector box 50. The screen 52 catches the particulate matter washed into the collection box housing 50 while the fluid continues to fall through the screen into the bottom of the collector box housing 50. The liquid is continually drained from the housing 50 through the drain hose 58. After one or more cleaning operations have been completed, the screen can be cleaned by sliding the screen 52 out of the collector box 50 and dumping the particulate matter in an appropriate disposal bin.

In any event, whenever it is desired to resume the slicing of food products, the plungers 74 are pressed inwardly against the pressure of the springs 78 so that the housing 64 can slide downwardly along the legs 20 until the lateral flanges 68 abut against the frame section 16.

Thus, the present invention provides a food slicer stand which collects food scraps and juices during use of the slicer and which permits the slicer to be cleaned in a quick and convenient manner. Consequently, the slicer can be used for slicing a wide variety of food products without time consuming clean up between uses in order to avoid intermixing of the food flavors. Moreover, the ready availability of an antiseptic solution prevents the build up of harmful residues which can affect the flavor and quality of food being sliced. In addition, even though the cleaning solution and the food scraps are collected by a single receptacle, a filter screen prevents clogging of the drain by removing particulate matter from the fluid which is continually expelled from the stand toward an appropriate drain.

Having thus described my invention, many modifications thereto will become apparent to those skilled in the art to which it pertains without departing from the scope and spirit of the present invention as defined in the appended claims. For example, while the stand has been described as particularly adapted for use with a food slicer, it will be readily understood by those skilled in the art that it is well adapted for use with other food processing machines and useful appliances which can be cleaned by spraying.

What is claimed is:

1. A support stand for a food processing apparatus comprising:

a perimeter frame comprising framing members defining a central opening, and having a plurality of support legs secured to said frame so that said perimeter frame is substantially horizontally supported on top of said legs;

means for supporting a food processing apparatus over said opening;

a tubular, open-ended housing and means for slidably entraining said housing about said frame so that said housing is slidable between an upper position in which it substantially encloses the food processing apparatus therein and a lower position in which said housing is positioned below the food processing apparatus;

means for releasably maintaining said housing in said upper position;

means for releasably maintaining said housing in said lower position;

sealing means for providing a watertight seal between said housing and said frame when said housing is in said upper position; and a drain receptacle having an open top secured below said central opening and means for draining said receptacle.

2. The invention as defined in claim 1 and further comprising conduit means for directing a pressurized flow of fluid throughout said tubular housing.

3. The invention as defined in claim 2 wherein said conduit means includes means for siphoning a disinfectant fluid into said pressurized flow of fluid.

4. The invention as defined in claim 1 wherein said means for supporting said processing apparatus comprises at least one platform having a surface area less than the area of said opening.

5. The invention as defined in claim 4 wherein said at least one platform comprises a plurality of platform members and means for displaceably supporting each of said plurality of platform members within said central opening.

6. The invention as defined in claim 1 wherein said means for draining said receptacle includes means for filtering particulate matter from fluid.

7. The invention as defined in claim 6 wherein said means for draining comprises an open ended tubular drain housing, said means for filtering comprises a screen and means for removably supporting said screen in a position across an open end of said tubular drain housing.

8. The invention as defined in claim 1 wherein said frame includes means for displaceably supporting said frame on a ground surface.

9. The invention as defined in claim 1 wherein said framing members comprise elongated members having a substantially U-shaped cross section disposed with the channel facing downwardly and wherein the upper edge of said receptacle is engaged in said channel.

* * * * *